United States Patent [19]

Larsson et al.

[11] 4,251,266

[45] Feb. 17, 1981

[54] METHOD FOR TAKING CARE OF METALLIC WASTE PRODUCTS BY REMELTING

[75] Inventors: Owe G. T. Larsson, Ekshärad; Rune H. Lindström; Bo L. L. Jonsson, both of Hagfors, all of Sweden

[73] Assignee: Uddeholms Aktiebolag, Hagfors, Sweden

[21] Appl. No.: 74,311

[22] Filed: Sep. 11, 1979

[30] Foreign Application Priority Data

Oct. 25, 1978 [SE] Sweden ..... 7811104

[51] Int. Cl.[3] ..... C21C 5/52

[52] U.S. Cl. ..... 75/10 R; 75/65 R; 75/82

[58] Field of Search ..... 75/10–12, 75/65 R, 82

[56] References Cited

U.S. PATENT DOCUMENTS 3,519,059 7/1970 Voskoboinikov ..... 75/10 R

*Primary Examiner*—P. D. Rosenberg

*Attorney, Agent, or Firm*—Murray and Whisenhunt

[57] ABSTRACT

Method of taking care of the contents of valuable metals in grindings and other waste products of superalloys. The material is led into a metallic melt, preferably by injecting it by means of a carrier gas. The charge is heated up in the inductive way. The material contains aluminium and/or tantalum, or can these elements be added separately to the charge, thus preventing an oxidation of such valuable metals as vanadium, tantalum and niobium and obtaining a high yield of these elements. After the remelting, aluminium and/or titanium can be selectively oxidized by injecting into the charge oxygen and/or water vapor, a slag having a certain oxygen potential or a metal oxide where the metal has a lower affinity to oxygen as compared with aluminium and/or titanium.

10 Claims, No Drawings

METHOD FOR TAKING CARE OF METALLIC WASTE PRODUCTS BY REMELTING

The present invention provides a method by remelting to take care of metallic waste products containing significant amounts of at least one of the metals belonging to groups Va and VIa of the periodic table. More precisely the invention refers to a method for taking care of waste products of superalloys as they are called, by which are meant heat-resisting alloys based on nickel, iron-nickel or cobalt. In order to obtain sufficient corrosion resistance, these alloys normally hold a high content of chromium and often also an important content of molybdenum and/or tungsten, i.e. metals belonging to group VIa of the periodic table. Furthermore, superalloys often also hold significant contents of vanadium, niobium and/or tantalum, i.e. metals belonging to group Va of the periodic table. By "significant contents" in this case are meant at least 0.5% and 1.5% for vanadium and niobium/tantalum respectively. Waste products of superalloys therefore represent important values.

According to the prior art one has as far as possible, using the techniques known, tried to take care of waste products of superalloys. These waste products can e.g. consist of sprue from moulding operations, discards, turnings, grindings, etc., from the production and machining of superalloys. The normally used technique is to melt the material in electric arc furnaces, converters or induction furnaces, normally high-frequency furnaces. The problems arising in this connection are principally of two different kinds. Firstly, the yield of such valuable but easily oxidized elements as vanadium, niobium and tantalum is very low by these metals oxidizing due to air having access to the melting. Secondly, considerable properties to the finished product, especially when the material contains strong nitride forming elements like titanium and aluminium which often accur, as precipitation hardening elements in superalloys and together with nitrogen may in the unmolten material form detrimental titanium-carbo-nitrides and aluminium nitrides respectively.

A purpose of the invention is therefore to be able to remelt alloys of the kind mentioned in the preamble so as to the greatest possible extent avoid oxidation of valuable, desirable elements or to get as high a yield as possible of these elements.

A purpose is also essentially to prevent solution of nitrogen into the charge in remelting.

A special purpose is also essentially to deoxidize selectively such strong nitride forming elements as aluminium and titanium and at the same time achieve a high yield of vanadium, tantalum and/or niobium.

Furthermore, a special purpose is to be able to remelt sulphurous grindings of superalloys under contemporaneous desulphurazation.

These and other aims being difficult to combine can be met according to the invention by the waste products being remelted by being entered in a charge into an inductibely heated furnace belonging to the group consisting of ladle furnaces, crucible furnaces and converters, and by a non-nitrogenous gas being let into the furnace room in remelting. The products to be remelted can e.g. be added in batches from the top which is the natural way of charging when the products consist of major bodies. In those cases where the products are finely dispersed or can be easily fine-dispersed, e.g. when they consist of grindings or shavings, it is more suitable to inject the material into the charge. For this a lance can be used, thrust into the charge or a tuyere in the wall or bottom of the melting furnace. As a carrier gas is used the above-mentioned, non-nitrogenous gas which thus passes the charge before coming into the furnace room above the surface of the charge.

By leading a non-nitrogenous gas into the furnace chamber during the remelting process and by using a ladle furnace, crucible furnace or converter as a melting vessel, a possibility is created of minimizing the direct pick-up of nitrogen from the furnace atmosphere, especially if the ladle furnace or crucible furnace be provided with a cover or the converter have a small aperture in relation to the furnace volume. This holds good in particular, if the material to be remelted be injected directly into the charge so that in remelting it is surrounded by the molten phase. However, according to the invention the method offers further possibilities of reducing the nitrogen pick-up. Such a method is to have on the charge surface a liquid slag, vased on lime, which will act as a barrier between the furnace atmosphere and the charge as far as nitrogen is concerned. According to the invention it is possible to keep the nitrogen content at 0.006% in the finished material, which is an acceptable level.

The waste material to be remelted however also contains considerable amounts of oxygen, above all in the form of oxides. In order that the desired alloying elements from groups Va and VIa of the periodic table i.e. metals as vanadium, niobium and tantalum on one side and chromium, molybdenum and tungsten on the other, shall not get lost by going into the slag in the form of oxides, it is desirble that the oxygen of the remelting material be consumed selectibely. According to another aspect of the invention further reducers can be added beyond those in the form of aluminium, titanium and silicon being present as alloying elements in the material to be remelted. These added reducers can e.g. consist of further amounts of aluminium, titanium and silicon, silicon in the form of silicon calsium for instance. Because of the fact that aluminium, titanium and possibly other strong oxidizers, like silicon, are thus present in excess in the charge as compared with available oxygen, selective oxidation of aluminium and titanium is achieved by injecting oxygen into the charge, e.g. in the form of oxygen and/or water vapour, metal oxide or a slag having a certain oxygen potential.

Another element which can be present in the superalloy remelting material is sulphur. This is particularly the fact when the melting material consists of dust from grinding of superalloys by means of sulphide-bonded grinding wheels. According to another aspect of the method as per the invention it is possible to desulphurize such material efficiently by adding a sulphur-refining element to the charge. The good sulphur purifying effect is then depending on the charge being well deoxidized due to the presence of aluminium in the charge, wherein said aluminium is added as an alloying element to the material to be remelted and/or as an extra addision to achieve the above-mentioned selective oxidation. As a sulphurrefining element can be added lime or silicon calcium, the latter element then also contributing positively to governing the oxygen potential so that oxidation of vanadium, niobium and/or tantalum is avoided to the greatest extent possible. The sulphur-purifying element is best injected into the charge. Preferably it is injected together with the remelting material in the case this consists of a powder.

Further advantages, characteristics and aspects of the invention will appear from the following description of laboratory experiments carried out.

As experimental apparatus was used an inductively heated crucible furnace with injection equipment for laboratory use. The injection equipment consisted of a dispenser for the preparation of a gas/powder suspension and a lance for injecting the gas/powder suspension into the charge of the furnace. Furthermore, there was an extra lance for letting argon directly into the furnace room above the surface of the charge. At the beginning of the test there was in the furnace a charge consisting of 10,900 grammes of pure iron. Into this charge were injected 5,000 grammes of grinding dust from a superalloy of the trade name INCONEL 718 the nominal composition of which is 0.45% C, 18.5% Cr, 52% Ni, 3% Mo, 0.55% Al, 1% Ti, 5.15% Nb. The grinding dust had a grain size of less than 0.5 mm and was fed at a rate of roughly 100 grammes/minute. Argon was used as a carrier gas. During the major part of the experiment the temperature of the bath was above 1,700° C. During the remelting process, aluminium was added to the bath, but not enough wholly to avoid oxidation of niobium. Furthermore it was not possible using this experimental equipment to avoid some air leaking into the furnace room, a thing which also contributed to some Nb being oxidized. However, a niobium yield of roughly 48% was obtained, calculated on the nominal content. As a comparison there was obtained, when remelting the same kind of material in an arc furnace, a niobium yield of roughly 9% only.

The method according to the invention can be varied within the scope of the subsequent patent claims. It is e.g. possible, as was said in the preamble, to add the remelting products in batches from above. Then the charge is at the same time agitated by the injection of a powder and/or a non-nitrogenous gas.

We claim:

1. In a method of remelting metallic waste products containing significant amounts of at least one of the metals belonging to groups Va and VIa of the periodic table, to recover the waste products in a remelted form the improvement comprising remelting the waste products by feeding them into a molten metallic charge in an inductively heated furnace having a non-nitrogenous inert gas fed into the furnace room above the surface of the charge during the remelting process.

2. Method according to claim 1, wherein the said waste products being injected into the charge are in the form of a powder carried by means of a non-nitrogenous carrier gas.

3. Method according to claims 1 or 2, wherein titanium, aluminum and/or silicon are added to the charge during the remelting process in order essentially to prevent the oxidation of vanadium, tantalum and/or niobium in case one of these elements is existing in the waste products.

4. Method according to claims 1 or 2, wherein a lime-based slag is provided on the surface of the charge in order to reduce the pick-up of nitrogen into the charge from the environment.

5. Method according to claim 1, wherein a sulphur-purifying element is added to the charge, preferably in the form of a powder which is injected into the charge.

6. Method according to claims 1 or 5, wherein the waste products at least partly contain sulphurous grindings obtained in the grinding of superalloys.

7. Method according to claim 1, wherein the waste products are at least partly added to the molten metallic charge by batches from above the charge with simultaneous agitation of the charge by injecting a powder and/or a non-nitrogenous gas.

8. Method according to claim 1, wherein the furnace is a ladle furnace.

9. Method according to claim 1, wherein the furnace is a crucible furnace.

10. Method according to claim 1, wherein the furnace is a converter.

* * * * *